US012668969B2

(12) United States Patent
Bergman

(10) Patent No.: US 12,668,969 B2
(45) Date of Patent: Jun. 30, 2026

(54) CONNECTOR

(71) Applicant: Richard Bergman, Ottawa (CA)

(72) Inventor: Richard Bergman, Ottawa (CA)

( * ) Notice: Subject to any disclaimer, the term of this patent is extended or adjusted under 35 U.S.C. 154(b) by 144 days.

(21) Appl. No.: 18/619,059

(22) Filed: Mar. 27, 2024

(65) Prior Publication Data

US 2025/0305275 A1 Oct. 2, 2025

(51) Int. Cl.
*E04B 1/38* (2006.01)
*E04B 1/58* (2006.01)

(52) U.S. Cl.
CPC .... *E04B 1/5831* (2013.01); *E04B 2001/5887* (2013.01)

(58) Field of Classification Search
CPC ..... E04B 1/5831; E04B 2001/5887; E04B 2001/5856
See application file for complete search history.

(56) References Cited

U.S. PATENT DOCUMENTS 949,394 A 2/1910 Daly
2,037,736 A 4/1936 Payne et al.
2,931,129 A 4/1960 Boniface
3,222,841 A * 12/1965 Lipof ..... E04C 3/06 52/63
3,264,021 A * 8/1966 Artman ..... F16B 12/50 403/3
3,424,178 A * 1/1969 Yoshimi ..... E04B 1/34326 135/160
3,653,697 A * 4/1972 Ernst ..... E04B 1/585 403/29
3,672,710 A * 6/1972 Kroopp ..... F16B 7/0466 403/201
4,076,431 A 2/1978 Burvall
4,125,973 A 11/1978 Lendrihas
4,353,661 A * 10/1982 Ruther ..... F16B 21/02 403/174
4,934,858 A * 6/1990 Beaulieu ..... F16B 12/40 403/174
5,144,780 A * 9/1992 Gieling ..... F16B 7/04 52/298
5,403,110 A * 4/1995 Sammann ..... E04B 1/5831 52/712
5,590,974 A * 1/1997 Yang ..... A47B 47/005 403/171
5,680,737 A * 10/1997 Sheipline ..... F16B 7/0453 403/205

(Continued)

*Primary Examiner* — Basil S Katcheves

(57) ABSTRACT

There is disclosed a modular connector for coupling a plurality of frame members to each other. Primary and secondary sleeves of the modular connector are elongated along their respective axes so as to be suitable to engageably receive therein corresponding frame members. A plurality of slots are defined on an axially extending outer face of the primary sleeve. A plurality of tabs extend outwardly from a terminal end of the secondary sleeve. The plurality of tabs are receivable in the plurality of slots to position the primary and secondary sleeves relative each other. An end plate extends inwardly from about the terminal end of the secondary sleeve to abut and fasten to the outer face of the primary sleeve when each of the plurality of tabs is engaged with the plurality of slots to allow removable coupling of the primary sleeve to the secondary sleeve.

21 Claims, 11 Drawing Sheets

(56) References Cited

U.S. PATENT DOCUMENTS

| | | | | |
|---|---|---|---|---|
| 6,095,361 | A * | 8/2000 | Huang | H05K 5/30 220/9.4 |
| 6,402,414 | B1 * | 6/2002 | Kanodia | B62D 23/005 296/205 |
| 8,468,775 | B2 * | 6/2013 | Vaughn | E04C 3/32 52/843 |
| 10,368,639 | B1 * | 8/2019 | Lai | A47B 95/00 |
| D887,025 | S | 6/2020 | Styrc et al. | |
| 10,858,819 | B2 | 12/2020 | Styrc | |
| 11,332,920 | B2 * | 5/2022 | Houghton | E04B 1/30 |
| 2002/0044823 | A1 * | 4/2002 | Sosa | F16B 7/18 403/382 |
| 2005/0163564 | A1 * | 7/2005 | Tuell | E04B 1/5831 403/403 |
| 2008/0110112 | A1 * | 5/2008 | Yu | E04B 2/7422 52/239 |
| 2023/0041026 | A1 * | 2/2023 | Kim | E04B 1/5831 |

* cited by examiner

CONNECTOR

TECHNICAL FIELD

The disclosure relates generally to construction of building structures, and more particularly to connectors used to couple structural members to each other in the construction of such building structures.

BACKGROUND

Connection brackets function to simplify and strengthen the union of orthogonal and non-orthogonal members of various structures, such outdoor decks, pavilions, gazebos, pergolas, or other structures useful for providing shade, cover, or privacy. Most commonly, these connection brackets are made of metal and the members themselves are most commonly made of dimensional lumber.

In U.S. Pat. No. 949,394, Daly describes a device comprising a plurality of three-sided tubes orthogonally oriented to each other and welded into a unitary assembly. In U.S. Pat. No. 2,931,129, Boniface teaches to weld tubes in various configurations to form a unitary bracket that accepts elongate dimensional lumber. It is proposed by Boniface that construction of framed shed-like structures is facilitated by such a plurality of arranged unitary brackets. In U.S. Pat. No. 4,076,431, Burvall teaches how to build framed structures with a sloped roof and common ridge using universal connecting brackets. These structures being coverable with canvas or other similar fabric to provide protection against rain or snow. In U.S. Pat. No. 10,858,819, Styrc teaches to weld the terminal ends of a plurality of metal tubes oriented in a common plane against a central orthogonal tube to create a unitary assembly into which posts (generally dimensional lumber) are fitted.

Devices disclosed in the prior art can be used for construction of modular structures for providing shade, cover, or privacy, by arranging unitary connectors in a desired manner and coupling the resulting arrangement of unitary connectors to each other using structural members, such as dimensional lumber.

The unitary connectors are commonly welded as a finished good and occupy a significant volume of space. Many of these modular assemblies are quite large and must be shipped in large boxes with low weight to volume ratios which generally increases shipping costs. A variety of unitary connector types need to be stocked by sellers to accommodate the variety of connection types, e.g. a four-corner connection, or an angled roof truss connection. Users, such as contractors and builders, need to carefully plan to determine the types of connectors needed in a particular construction. Variants may need to be included to account for unexpected situations arising during constructions. For large constructions, specialized delivery to the construction site may be needed, increasing costs and delays in construction.

Generally, once a structure is built using connectors, it is not particularly amenable to modification. For example, in order to add a horizontal post to a pre-existing vertical post, the structure may need to be dismantled in order to replace the connector with a connector accommodating the additional horizontal post.

Improvement is desired.

SUMMARY

It is found that problems discussed herein may be solved by using a modular connector that may be readily assembled and/or reconfigured into different configurations. For outdoor structures like pergolas, pavilions, or gazebos the most common assembly (or structure) is a three-post corner assembly comprising a vertical post (or member) and two horizontal orthogonal posts (or members). Other assemblies include a vertical post with two, four, or five horizontal orthogonal posts or two non-orthogonal posts. For such a modular connector, it is desirable to achieve a large number of configurations of the modular connectors using as a few unique parts as possible so as to allow building of a large variety of structures.

Advantageously greater design flexibility may be achieved, including the ability to add on to an existing structure without having to dismantle and rebuild a structure. For example, a user that initially installed a four-post pergola structure using three-post corner connection assemblies may later decide to extend the length of the structure. The modular connector disclosed herein may permit horizontal sleeves to be easily added to the three-post assemblies converting them to four-post connection assemblies with a pleasing aesthetic appearance. For example, a weld-free appearance may be readily achieved.

Accordingly, in some aspects herein, there is disclosed a modular connector for coupling a first frame member to a second frame member at a predetermined angle. The modular connector also includes a first sleeve defining a first longitudinal axis and a first socket suitable to receive therein the first frame member, the first sleeve having an axially extending outer face, the outer face defining a plurality of slots thereon; and a second sleeve defining a second longitudinal axis, a terminal end along the second longitudinal axis, and a second socket suitable to receive therein the second frame member, the second sleeve including: a plurality of tabs extending away from the second socket from the terminal end, the plurality of tabs being receivable in the plurality of slots to position the second sleeve relative to the first sleeve, and an end plate extending from the terminal end towards the second socket to abut and fasten to the outer face of the first sleeve when each of the plurality of tabs is engaged with the plurality of slots to allow removable coupling of the first sleeve to the second sleeve, the end plate being angled relative to the second longitudinal axis to position the first frame member at the predetermined angle relative to the second frame member when the end plate is fastened in abutment to the outer face.

Implementations may include one or more of the following features. A first plurality of apertures is defined on the outer face and is complementary to a second plurality of apertures of the end plate, the first and second plurality of apertures being suitable to receive fasteners to allow engagement of the first sleeve with the second sleeve via the fasteners. Each of the first plurality of apertures is axially spaced apart from the plurality of slots and opens to the first socket to allow the fasteners to extend into the first socket via the first plurality of apertures to fasten the second sleeve to the first frame member. Each of the plurality of tabs is substantially non-parallel to the end plate. The plurality of tabs and the end plate are positioned at opposite lateral sides of the second sleeve. The plurality of tabs includes two spaced-apart tabs positioned at a common side of the second sleeve opposite to the end plate. The first sleeve includes a plurality of depressions extending from the outer face into the first socket to space the first frame member away from the first sleeve to form a gap receiving the plurality of tabs when the first frame member is received in the first sleeve. Each of the plurality of depressions is suitable to receive a corresponding fastener to allow fastening of the first sleeve to the first frame member. A first plurality of apertures is defined on the outer face and is complementary to a second plurality of apertures of the end plate, the first and second plurality of apertures being suitable to receive fasteners to allow engagement of the first sleeve with the second sleeve via the fasteners, the first plurality of apertures being axially spaced apart from the plurality of slots, a depression of the plurality of depressions being positioned axially in-between the first plurality of apertures and the plurality of slots. Each tab of the plurality of tabs is interlockable with a corresponding slot of the plurality of slots. The first sleeve includes a stiffener extending at least partially across the first socket, and being spaced apart from the plurality of slots to prevent interference with the first frame member. The first sleeve defines a quadrilateral cross-section, the stiffener being triangularly shaped and extending across two sides of the quadrilateral cross-section. The end plate is a first end plate, the second sleeve including a second end plate extending from the terminal end towards the second socket and opposite to the first end plate to abut and fasten to the outer face of the first sleeve when each of the plurality of tabs is received in the plurality of slots. The plurality of tabs includes two spaced-apart tabs positioned at a common side of the second sleeve opposite to the first end plate, the second end plate being positioned between the two spaced-apart tabs.

Accordingly, in some aspects herein, there is disclosed a structure. The structure also includes a first member, a second member, and a modular connector for coupling a first frame member to a second frame member at a predetermined angle. The modular connector also includes a first sleeve defining a first longitudinal axis and a first socket suitable to receive therein the first frame member, the first sleeve having an axially extending outer face, the outer face defining a plurality of slots thereon; and a second sleeve defining a second longitudinal axis, a terminal end along the second longitudinal axis, and a second socket suitable to receive therein the second frame member, the second sleeve including: a plurality of tabs extending away from the second socket from the terminal end, the plurality of tabs being receivable in the plurality of slots to position the second sleeve relative to the first sleeve, and an end plate extending from the terminal end towards the second socket to abut and fasten to the outer face of the first sleeve when each of the plurality of tabs is engaged with the plurality of slots to allow removable coupling of the first sleeve to the second sleeve, the end plate being angled relative to the second longitudinal axis to position the first frame member at the predetermined angle relative to the second frame member when the end plate is fastened in abutment to the outer face. The first frame member is the first member and the second frame member is the second member, the first member being received in the first sleeve, the second member being received in the second sleeve. The structure also includes a plurality of fasteners at least partially passing through the end plate, the outer face of the first sleeve, and the first member to cause frictional engagement therebetween to fasten the first sleeve, the second sleeve, and the first member to each other.

Implementations may include one or more of the following features. Each of the plurality of fasteners is received in a corresponding one of a plurality of apertures defined in each of the end plate and the outer face. The first sleeve includes a first plurality of depressions extending from the outer face into the first socket to frictionally engage with the first member, the second sleeve including a second plurality of depressions extending into the second socket to frictionally engage with the second member, each depression of the first and second plurality of depressions receiving a corresponding fastener of the plurality of fasteners. Each of the plurality of fasteners is received in a corresponding one of a plurality of apertures defined in each of the end plate and the outer face, and a depression of the first plurality of depressions being spaced-apart from and positioned axially in-between the plurality of apertures and the plurality of slots.

Accordingly, in some aspects herein, there is disclosed a sleeve of a modular connector for coupling a first frame member to a second frame member at a predetermined angle. The sleeve also includes and a plurality of slots defined on an axially extending outer face of the common sleeve, the sleeve being axially elongated and defining: an axially terminal end; a second socket suitable to engageably receive therein the second frame member; a plurality of tabs extending away from the second socket from the axially terminal end and receivable in the plurality of slots to position the sleeve relative to the common sleeve; and an end plate extending from the axially terminal end towards the second socket to abut and fasten to the outer face of the common sleeve when each of the plurality of tabs is received in the plurality of slots to allow removable coupling of the sleeve to the common sleeve, the end plate being angled to allow the first frame member to be positioned at the predetermined angle relative to the second frame member when the end plate is fastened in abutment to the outer face.

Implementations may include one or more of the following features. The sleeve may include a plurality of depressions extending laterally inwardly towards the second socket to cause an interference fit between the sleeve and the second frame member when the second frame member is received in the second socket. Each of the plurality of depressions defines an aperture for receiving a corresponding fastener to allow fastening of the sleeve to the second frame member, the sleeve may include a plurality of apertures suitable to receive a plurality of fasteners to allow engagement of the sleeve with the common sleeve and the first frame member via the fasteners. A first plurality of apertures is defined on the outer face and is complementary to a second plurality of apertures of the end plate, the first and second plurality of apertures being suitable to receive fasteners to allow engagement of the first sleeve with the second sleeve via the fasteners. Each of the first plurality of apertures is axially spaced apart from the plurality of slots and opens to the first socket to allow the fasteners to extend into the first socket via the first plurality of apertures to fasten the second sleeve to the first frame member. Each of the plurality of tabs is substantially non-parallel to the end plate. The plurality of tabs and the end plate are positioned at opposite lateral sides of the second sleeve. The plurality of tabs includes two spaced-apart tabs positioned at a common side of the second sleeve opposite to the end plate. The first sleeve includes a plurality of depressions extending from the outer face into the first socket to cause an interference fit between the first frame member and the first sleeve. Each of the plurality of depressions is suitable to receive a corresponding fastener to allow fastening of the first sleeve to the first frame member. A first plurality of apertures is defined on the outer face and is complementary to a second plurality of apertures of the end plate, the first and second plurality of apertures being suitable to receive fasteners to allow engagement of the first sleeve with the second sleeve via the fasteners, the first plurality of apertures being axially spaced apart from the plurality of slots, a depression of the plurality of depressions being positioned axially in-between the first plurality of apertures and the plurality of slots. Each tab of the plurality of tabs is interlockable with a corresponding slot of the plurality of slots. The first sleeve includes a stiffener extending at least partially across the first socket, and being spaced apart from the plurality of slots to prevent interference with the first frame member. The first sleeve defines a quadrilateral cross-section, the stiffener being triangularly shaped and extending across two sides of the quadrilateral cross-section. The end plate is a first end plate, the second sleeve including a second end plate extending from the terminal end towards the second socket and opposite to the first end plate to abut and fasten to the outer face of the first sleeve when each of the plurality of tabs is received in the plurality of slots. The plurality of tabs includes two spaced-apart tabs positioned at a common side of the second sleeve opposite to the first end plate, the second end plate being positioned between the two spaced-apart tabs.

Embodiments can include combinations of the above features. It is understood that one or more sleeves may be sold in packages or in kits.

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

Aspects of various embodiments are now described in relation to the figures.

Figure 1:
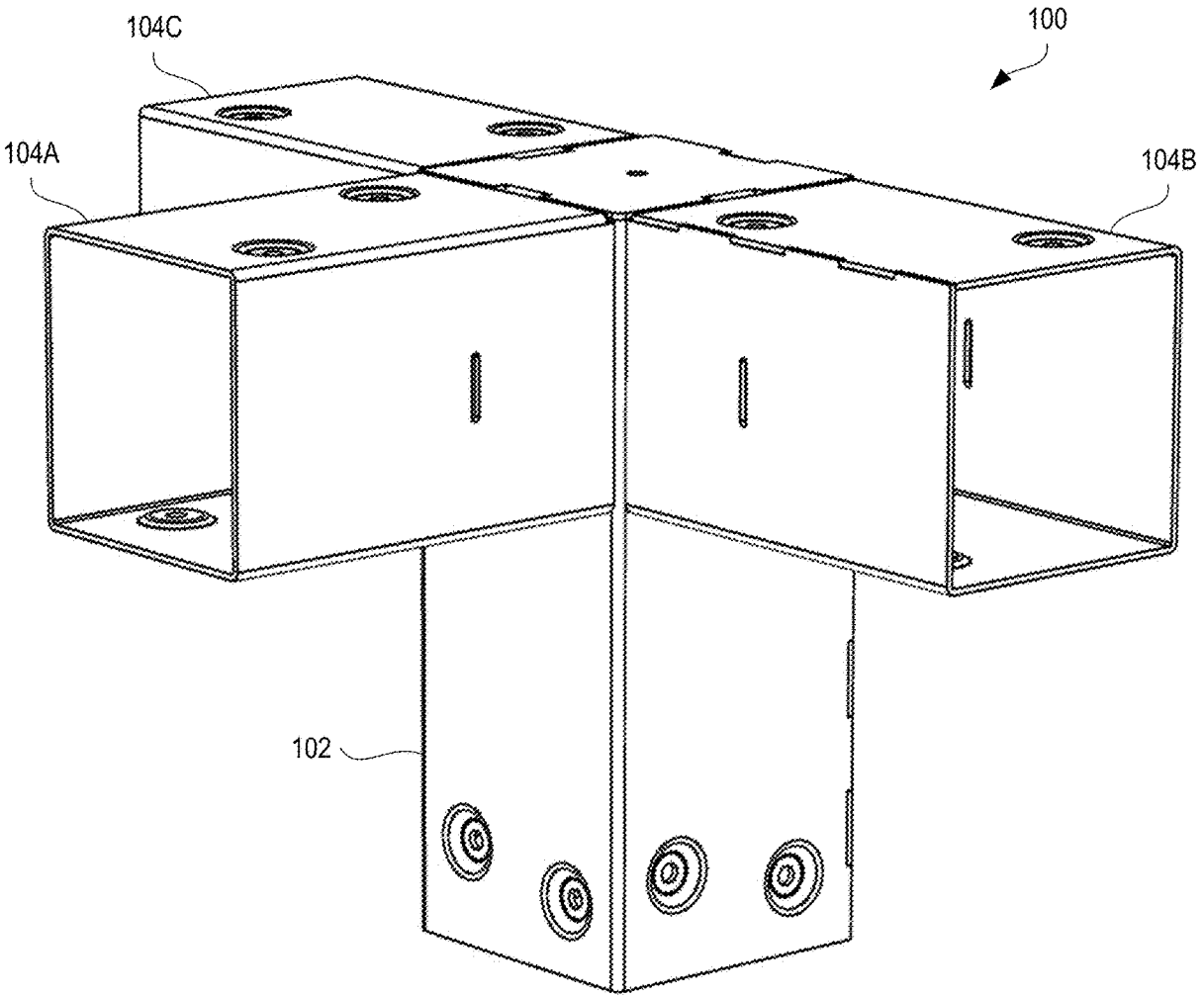
FIG. 1 is a perspective view of a modular connector, in accordance with an embodiment.

FIG. 1 is a perspective view of a modular connector 100, in accordance with an embodiment.

The modular connector comprises a primary sleeve 102 (also referred to as a common sleeve or first sleeve), and secondary sleeves 104A, 104B, 104C.

Figure 4B:
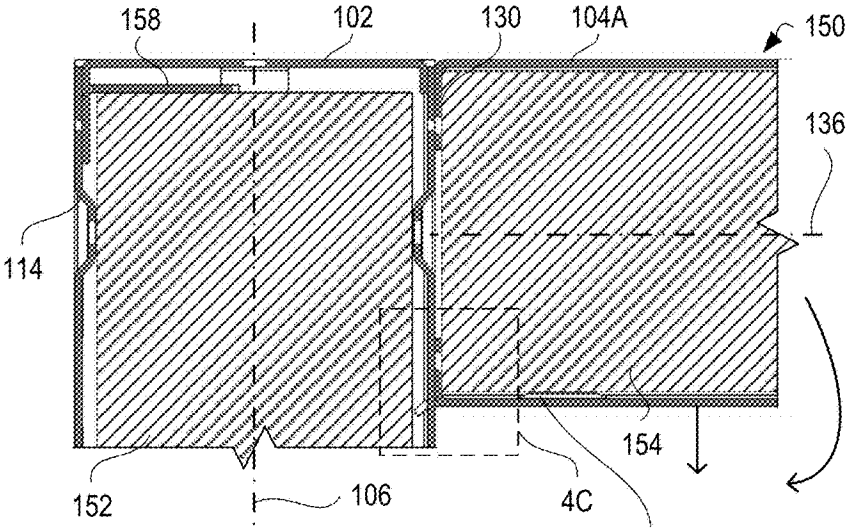
FIG. 4B is a partial cross-sectional view of the structure in FIG. 4A.
Figure 4C:
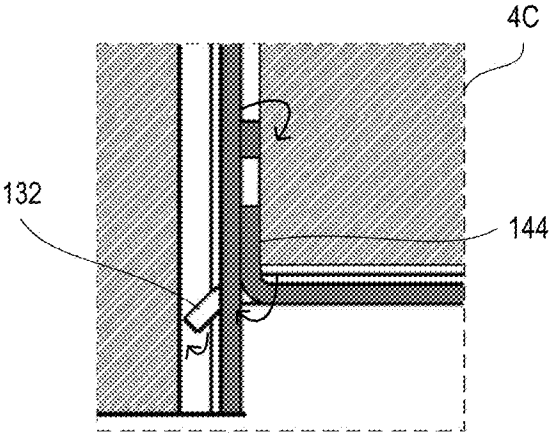
FIG. 4C is a magnified view of the region 4C in FIG. 4B.
Figure 4A:
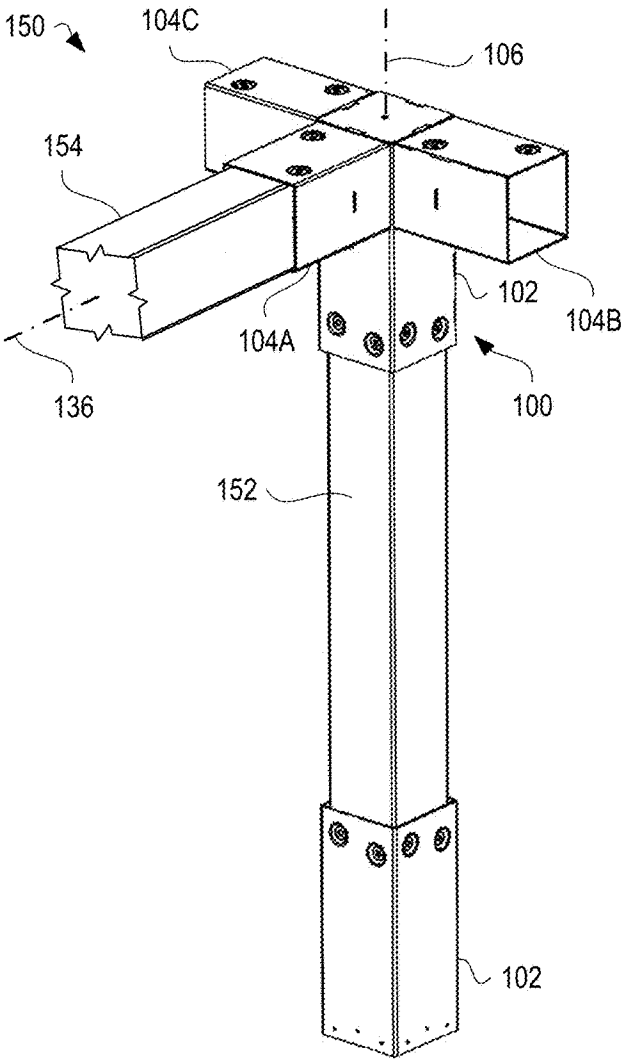
FIG. 4A is a perspective view of a structure formed using the modular connector, in accordance with an embodiment.

The modular connector 100 is suitable for coupling a primary frame member 152 (also referred to herein as primary member 152) to a secondary member 154 (also referred to herein as secondary member 154) at a predetermined angle 156, as shown in FIG. 4A and as further described herein.

Figure 2B:
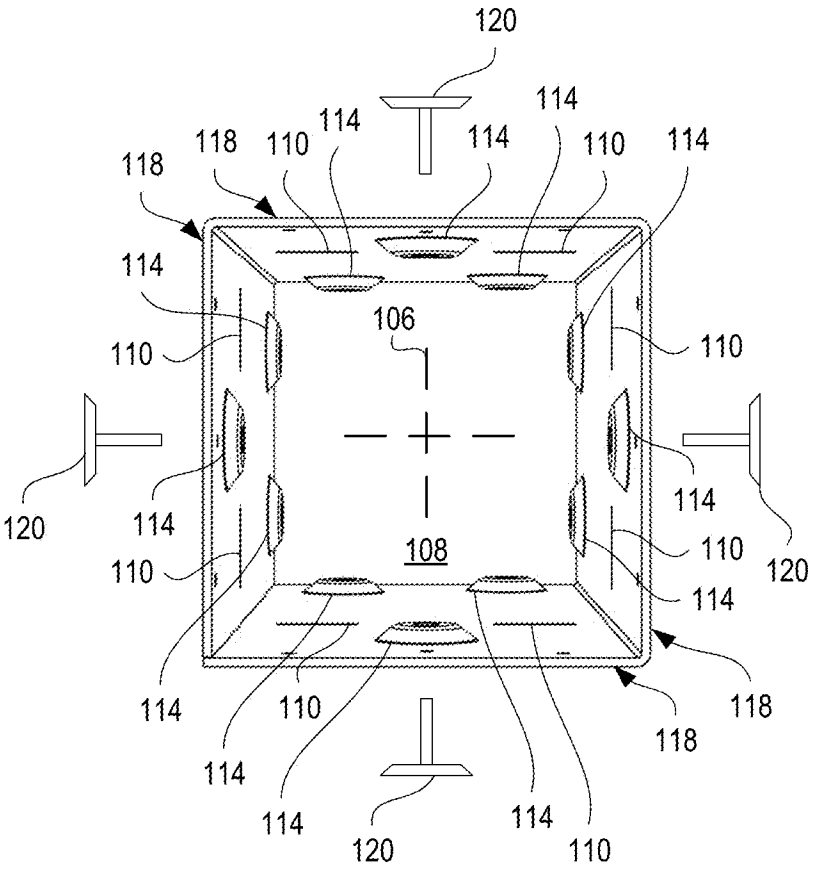
FIG. 2B is a front perspective view of the primary sleeve.
Figure 2A:
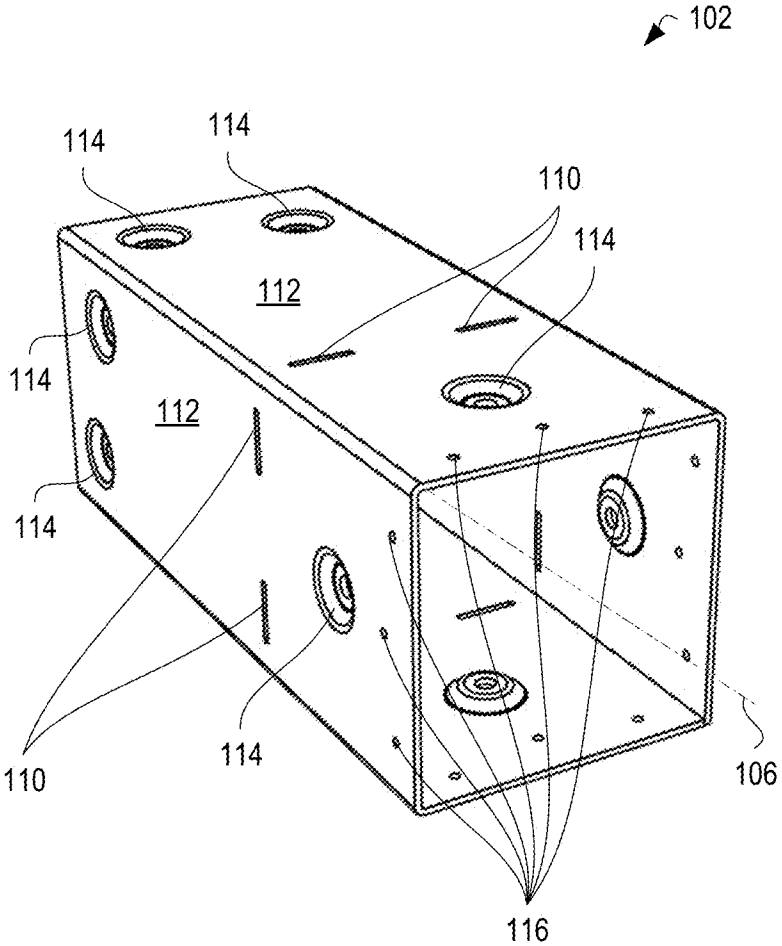
FIG. 2A is a perspective view of a primary sleeve of a modular connector, in accordance with an embodiment.
Figure 2C:
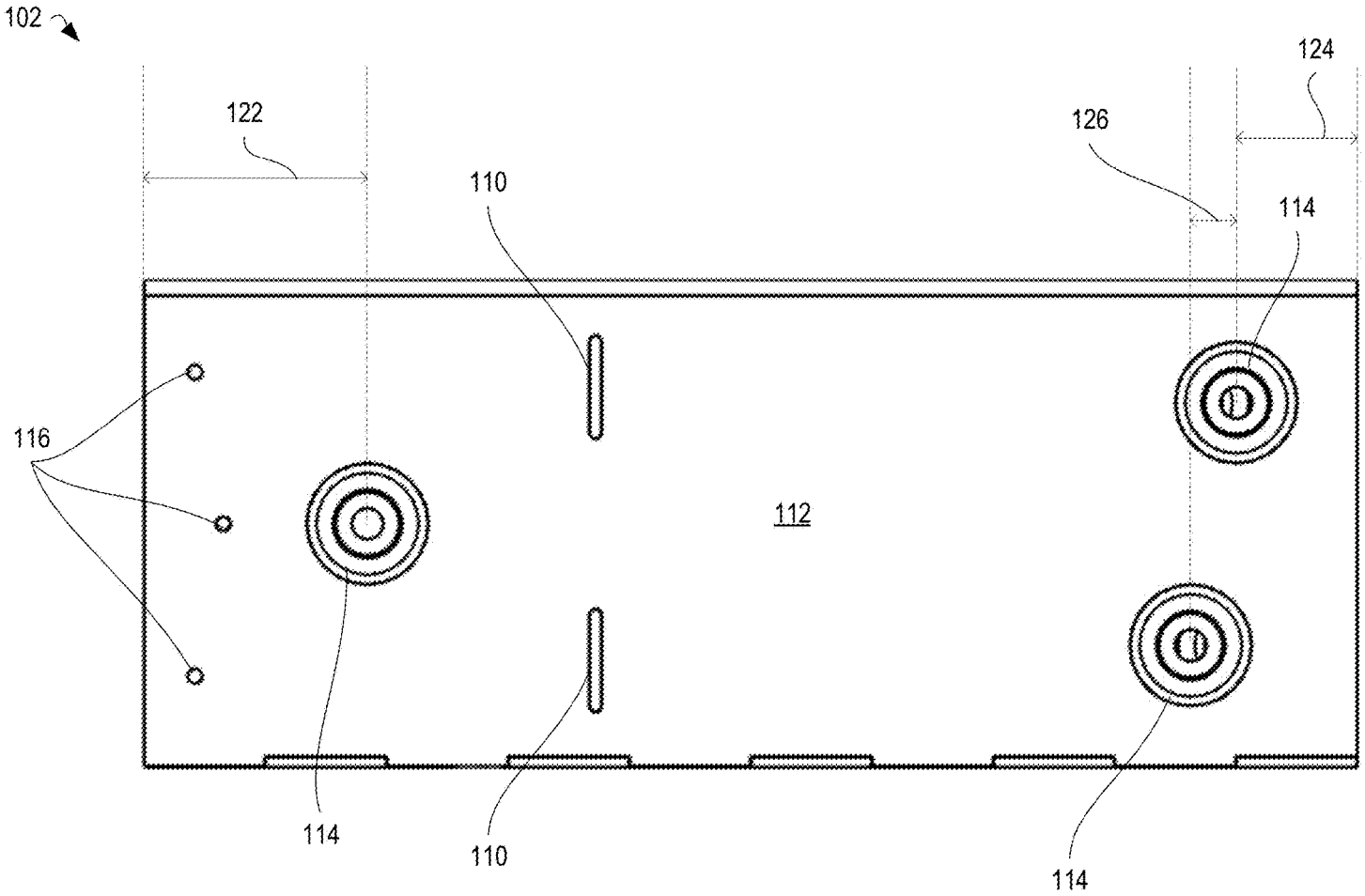
FIG. 2C is a side elevation view of the primary sleeve.

FIGS. 2A-2C are various views of an embodiment of the primary sleeve 102. FIG. 2A is a perspective view, FIG. 2B is a front perspective view, FIG. 2C is a side elevation view of the primary sleeve 102.

The primary sleeve 102 is elongated along a primary axis 106 (or first axis) so as to define a primary socket 108 (or first socket).

The primary socket 108 is suitable to receive the primary member 152. The primary socket 108 is suitable to engage with the primary member 152, e.g. the primary socket 108 may be configured to frictionally engage with the primary member 152.

The primary sleeve 102 may define one or more outer faces 112. The outer faces 112 may extend axially along the primary axis 106 (axially extending outer faces 112). A plurality of slots 110 may be formed on each outer face 112. The primary sleeve 102 may define a plurality of sides 118. The primary sleeve 102 may define four (lateral) sides 118, as shown in FIGS. 2A-2C. It is understood that the primary sleeve 102 may define more or less than four sides.

In various embodiments, the size and the shape of the primary sleeve 102 may be similar to the size and shape of the primary frame member 152 that is to be received in the primary sleeve 102.

A plurality of apertures 116 may be formed on the outer face 112 to open to the primary socket 108 to allow fasteners to pass therethrough to the primary frame member 152. Each of the first plurality of apertures 116 may be axially spaced apart from the plurality of slots 110.

The primary sleeve 102 may include a plurality of depressions 114 extending from the outer face 112 into the primary socket 108 to cause an interference fit between the primary frame member 152 and the primary sleeve 102, e.g. by biting into the primary member 152.

In various embodiments, the depressions 114 may be circular or non-circular depressions. In some embodiments, the depressions 114 may be elongated.

Each of the plurality of depressions is suitable to receive a corresponding fastener 120 (only four are shown in FIG. 2B for illustrative purposes) to allow fastening of the primary sleeve 102 to the primary frame member 152. In various embodiments, apertures may be provided in one or more of the plurality of depressions 114 to allow passage therethrough of a corresponding one of the fasteners 120 to fasten the primary sleeve 102 to the primary member 152. It was found to be particularly effective to fasten the primary sleeve 102 to the primary frame member 152 at the locations where the depressions 114 bite into (or press against) the primary sleeve 102.

As shown in FIG. 2C, in some embodiments, at least one depression 114 of the plurality of depressions 114 is positioned axially in-between the plurality of apertures 116 and the plurality of slots 110. Advantageously, positioning of the at least one depression 114 in-between the plurality of apertures 116 and the plurality of slots 110 may allow concealing of fasteners engaged with members via the at least one depression 114 once secondary sleeves is attached to the primary sleeve 102 adjacent to the at least one depression 114.

Two or more additional depressions 114 may be provided. For example, such depressions 114 may be axially spaced apart from each other by an offset 126. In various embodiments, the depressions may be spaced apart from one terminal end by a distance 124 of about 1 inch and spaced apart from another terminal end by a distance 122 of about 0.25 inch. Advantageously, offsetting depressions may help mitigate interference between fasteners that are driven through opposite sides, i.e. through depressions on opposite sides of (primary or secondary) sleeves. Advantageously, at least two depressions are provided to center and hold the member fixed in-placed via fasteners passing therethrough.

FIGS. 3A-3E are various views of an embodiment of a secondary sleeve 104, e.g. similar to one or more of the secondary sleeves 104A, 104B, 104B shown in FIG. 1.

Figure 3B:
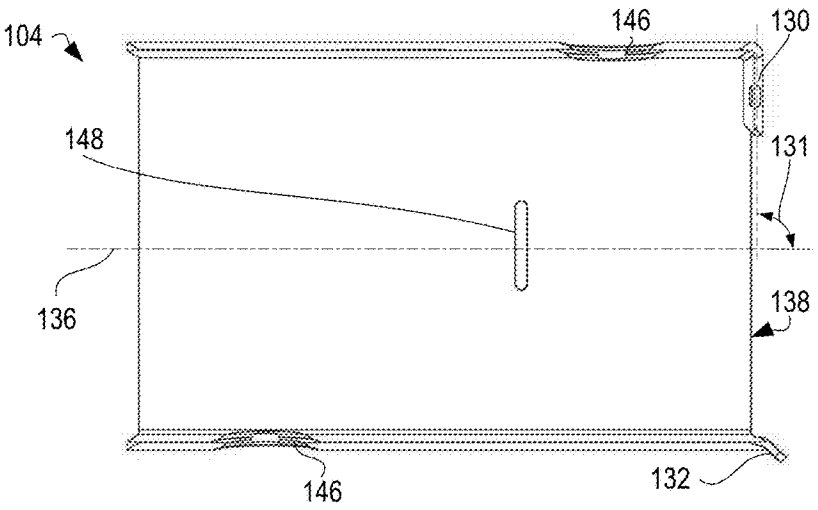
FIG. 3B is a cross-sectional view, in perspective, through the line 3B-3B in FIG. 3A.
Figure 3A:
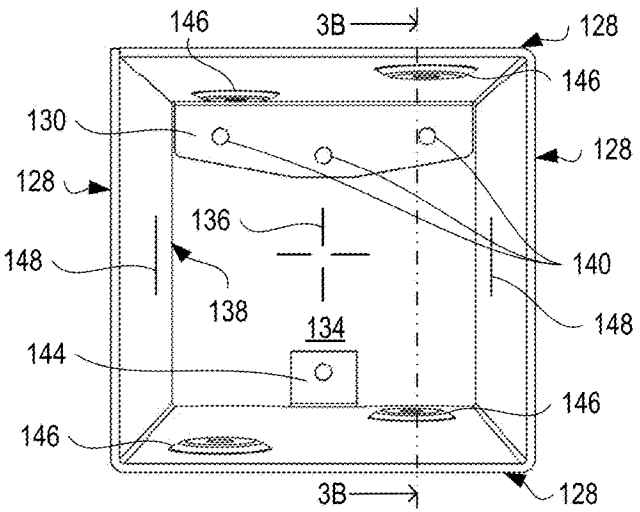
FIG. 3A is a rear perspective view of a secondary sleeve of a modular connector, in accordance with an embodiment.
Figure 3D:
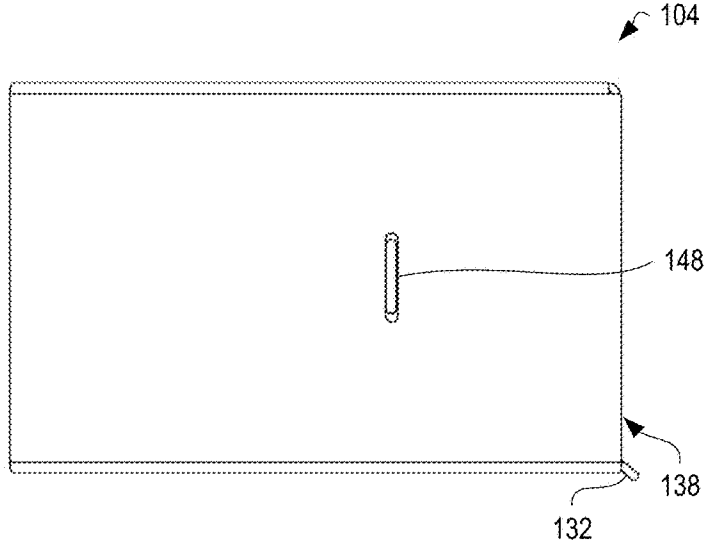
FIG. 3D is a side elevation view of the secondary sleeve.
Figure 3C:
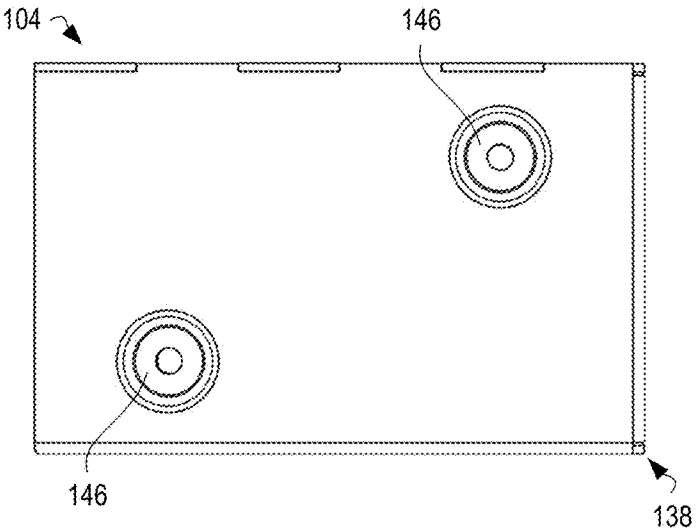
FIG. 3C is a top elevation view of the secondary sleeve.
Figure 3E:
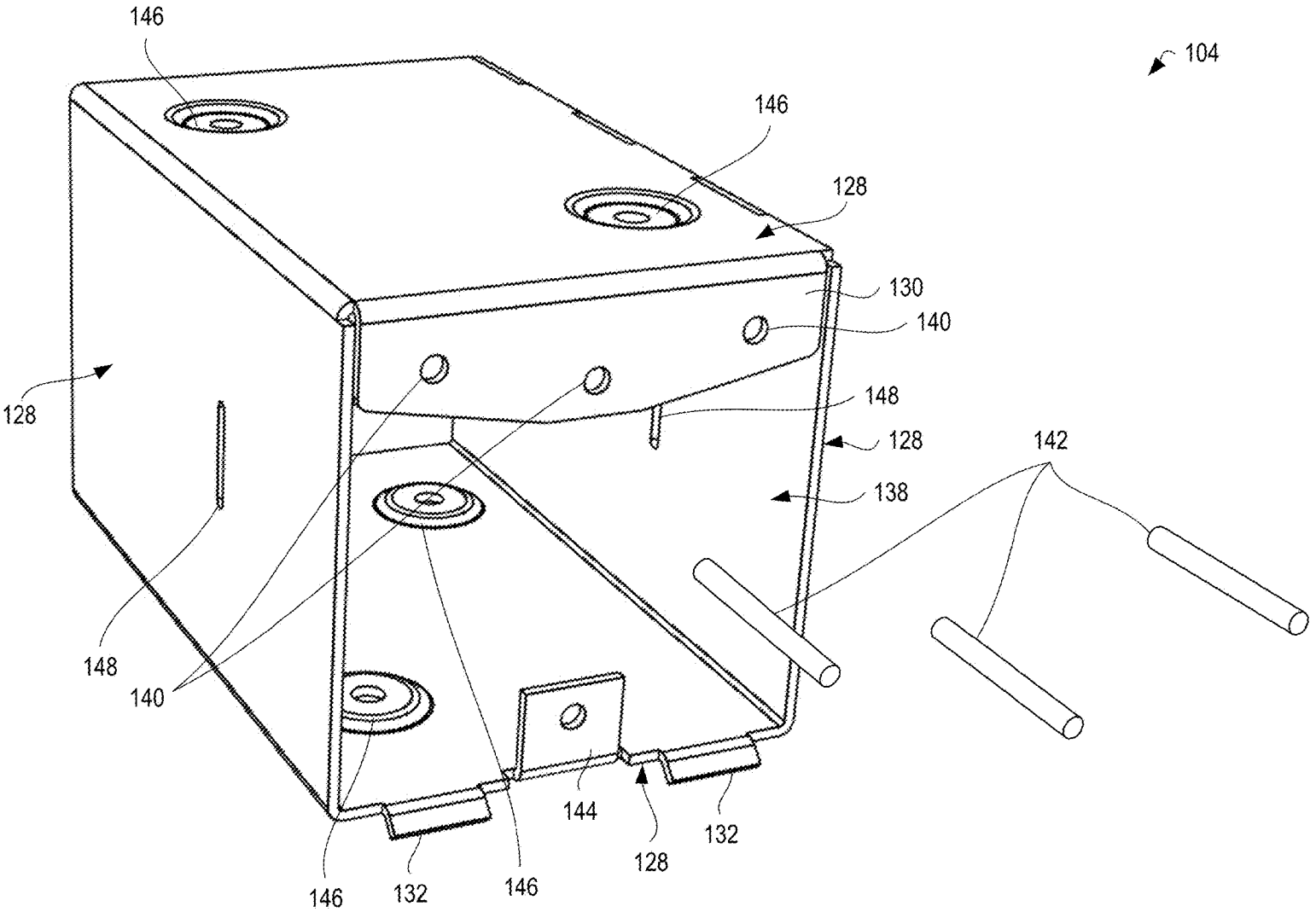
FIG. 3E is a perspective view of the secondary sleeve shown along with example fasteners.

FIG. 3A is a rear perspective view. FIG. 3B is a cross-sectional view, in perspective, through the line 3B-3B in FIG. 3A. FIG. 3C is a top elevation view. FIG. 3D is a side elevation view. FIG. 3E is a perspective view.

The secondary sleeve 104 is elongated along a secondary axis 136 to define a terminal end 138 along the secondary axis 136 and a secondary socket 134.

The secondary socket 134 is suitable to receive the secondary frame member 154. The secondary socket 134 may be suitable to engage with the secondary member 154, e.g. the secondary socket 134 may be configured to frictionally engage with the secondary member 154.

The secondary sleeve 104 includes an end plate 130 extending from about the axially terminal end 138 towards the secondary socket 134. The end plate 130 extends inwardly from an outer end of the secondary sleeve 104 in a lateral direction (laterally inwardly) to allow abutting and fastening of the end plate 130 to the outer face 112 of the primary sleeve 102 without needing an external fastening connection.

The end plate 130 may be angled relative to the secondary axis 136 to angle the primary frame member 152 at the predetermined angle 156 relative to the secondary frame member 154 (see angle 131 shown in FIG. 3B) when the end plate 130 is fastened in abutment to the outer face 112.

The secondary sleeve 104 may define a plurality of sides 128. The secondary sleeve 104 may define four (lateral) sides 128, as shown in FIGS. 3A-3E. It is understood that the secondary sleeve 104 may define more or less than four sides.

The secondary sleeve 104 includes a plurality of tabs 132 extending away from the secondary socket 134 from about the terminal end 138. In various embodiments, the plurality of tabs 132 may include two spaced-apart tabs 132 positioned at a common one of the sides 128 of the secondary sleeve 104 opposite to the end plate 130.

The plurality of tabs 132 are receivable in the plurality of slots 110 and may be complementary thereto. The plurality of tabs 132 may be complementarily receivable in the plurality of slots 110 to position the secondary sleeve 104 relative to the primary sleeve 102. In some embodiments, each tab 132 of the plurality of tabs 132 may be interlockable with a corresponding slot 110 of the plurality of slots 110.

In various embodiments, each of the plurality of tabs 132 may be substantially non-parallel to the end plate 130. In various embodiments, the plurality of tabs 132 may be angled relative to the end plate 130.

In various embodiments, the plurality of tabs 132 and the end plate 130 are positioned at opposite lateral sides (at an opposite pair of the sides 128) of the secondary sleeve 104.

Engagement of the plurality of tabs 132 with the plurality of slots 110 allows removable coupling of the primary sleeve 102 to the secondary sleeve 104 and positioning of the primary sleeve 102 relative to the secondary sleeve 104. When such positioning is achieved, the end plate 130 may be secured to the outer face 112 by fastening abutment thereof to the outer face 112.

In various embodiments, a supporting end plate 144 may be provided in addition to the end plate 130. The supporting end plate 144 may extend from about the terminal end 138 towards the secondary socket 134. The support end plate 144 may so extend opposite to the end plate 130 to abut and fasten to the outer face 112 of the primary sleeve 102 when each of the plurality of tabs 132 is received in the plurality of slots 110. In various embodiments, the supporting end plate 144 may be positioned between the two spaced-apart tabs 132.

In various embodiments, the end plate 130 and the supporting end plate 144 may be positioned at vertical ends (sides) of the secondary sleeve 104 in order to provide a reacting force and moment to forces and moments arising from the weight of the secondary member 154 while the same is attached to the primary member 152 via the modular connector 100 to be supported by the primary member 152.

A plurality of (end plate) apertures 140 may be formed on the end plate 130. The plurality of end plate apertures 140 (or apertures of the end plate) may be complementary to the plurality of apertures 116 of the primary sleeve 102 so as to receive fasteners 142. The primary sleeve 102 and the secondary sleeve 104 may be engaged with each other via the fasteners 142. In various embodiments, the fasteners 142 may be threaded fasteners such as screws or non-threaded fasteners such as rivets.

The secondary sleeve 104 may have formed thereon depressions 146 that extend into the secondary socket 134 to cause an interference fit between the secondary frame member 154 and the secondary sleeve 104, e.g. by biting into the secondary member 154.

In various embodiments, apertures may be provided in one or more of the plurality of depressions 146 to allow passage therethrough of a corresponding one of the fasteners to fasten the secondary sleeve 104 to the secondary frame member 154. It was found to be particularly effective to fasten the secondary sleeve 104 to the secondary frame member 154 at the locations where the depressions 146 bite into the secondary sleeve 104.

Figure 6B:
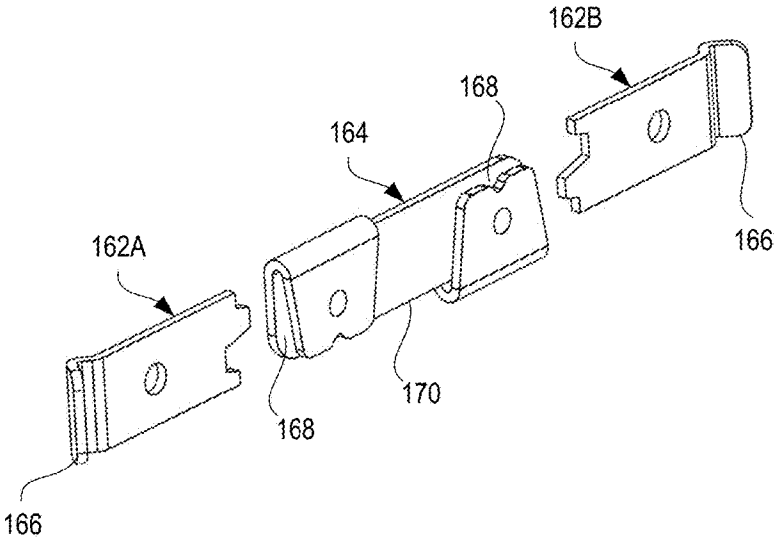
FIG. 6B is an exploded perspective view of the holder.
Figure 6D:
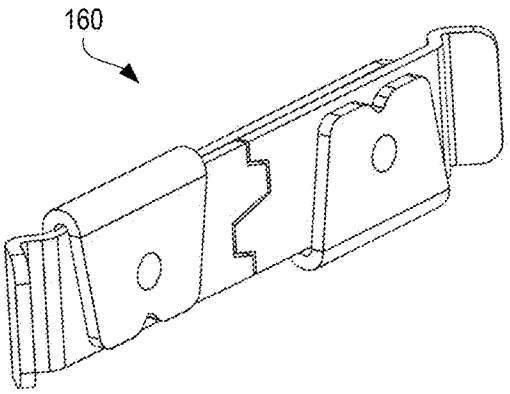
FIG. 6D is a front perspective view of the holder.
Figure 6A:
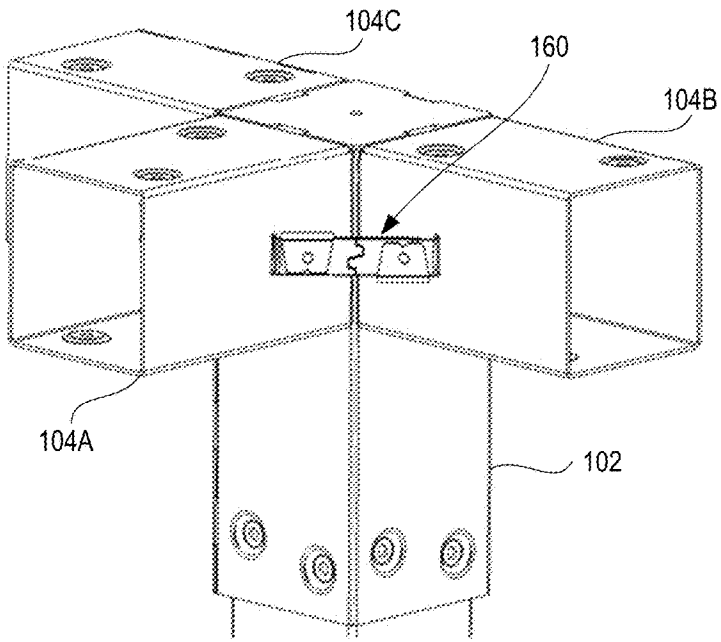
FIG. 6A is a perspective view of a holder mounted on a modular connector, in accordance with an embodiment.

The secondary sleeve 104 may have formed thereon one or more holder slots 148 to engage with a holder 160, as shown in FIG. 6A and further described in these paragraphs.

The first and secondary sleeves 102, 104 may be formed by bending of sheet metal. For example, a sheet metal of a predetermined length, width and thickness (e.g. 2 mm thickness) may be bent along three (parallel) lines on the sheet metal to form a sleeve with a quadrilateral (rectangular) cross-section. As shown in FIGS. 2B, 3A, three of the four corners of the cross-sections of the respective sleeves 102, 104 may be defined by metal bent into a corner with a prescribed radius while one of the four corners may be butt-joint or other type of joint between two ends of the sheet metal.

It is found that the depressions 146 of the secondary sleeve 104 need not be as deep as the depressions 114 of the primary sleeve 102. For example, since the primary sleeve 102 may be cross-sectionally larger than the secondary sleeve 104, the depressions formed in the primary sleeve 102 may be deeper than depressions formed in the secondary sleeve 104. The depth of the depressions may be configured so as to formed a sufficient frictional fit with the secondary member 154.

In various embodiments, the secondary sleeve 104 may be generally smaller than the primary sleeve 102. For example, improved mating between the primary sleeve 102 and the secondary sleeve 104 may thereby be achieved.

FIG. 4A is a perspective view of a structure 150 formed using the modular connector 100, in accordance with an embodiment.

The modular connector 100 is coupled to the frame members 152, 154 to form the structure 150 and to rigidly couple the frame members 152, 154 at a predetermined angle 156 to each other.

The primary sleeve 102 of the modular connector 100 (the socket 108) receives the primary member 152 and the secondary sleeve 104A (the socket 134) of the modular connector 100 receives the secondary member 154. As shown in FIG. 4A, the secondary sleeves 104B, 104C are shown without frame members received therein (in sockets thereof). It is understood that members may be engagingly received in one or more of the secondary sleeves 104B, 104C to form the structure 150 and/or one or more of the secondary sleeves 104B, 104C may be disconnected from the modular connector 100 to reconfigure the modular connector 100.

The primary and secondary sleeves 102, 104A are received in the respective primary and secondary members 152, 154. The primary and secondary sleeves 102, 104A may be frictionally engaged with the respective primary and secondary members 152, 154.

In some embodiments, the plurality of depressions 114 may press against, and form an interference fit with, the primary member 152. In some embodiments, the plurality of depressions 146 may press against, and form an interference fit with, the secondary member 154. The plurality of depressions 114, 146 may be frictionally engaged with the respective primary and second members 152, 154 so as to center and hold the members 152, 154 firm once these are fastened in-place. As described previously, each depression of the plurality of depressions 114, 146 receive a corresponding fastener, e.g. such fasteners may pass through apertures formed in the depressions 114, 146 and the respective primary and secondary members 152, 154. Each of the plurality of depressions 114, 146 may be substantially circular and/or curved inwardly (to form a concave depression) to cause self-alignment of fasteners into apertures formed therein.

The primary sleeve 102 and the secondary sleeve 104A are fastened to each other via the plurality of apertures 116, 140. The plurality of apertures 116, 140 may be suitable to receive the fasteners 142 to allow engagement of the primary sleeve 102 with the secondary sleeve(s) 104A, 104B, 104C, as well as the primary frame member 152 via the fasteners 142. The plurality of fasteners 116, 140 pass at least partially through the end plate 130, the outer face 112, and the primary frame member 152 to cause frictional engagement therebetween to fasten the primary sleeve 102, the secondary sleeve 104A, and the primary member 152 to each other. The structure 150 is then formed by coupling the secondary member 154 to the modular connector 100.

FIG. 4B is a partial cross-sectional view of the structure 150.

Fasteners coupling the end plates 130, 144 to the outer face 112, the primary sleeve 102 to the primary member 152, and the secondary sleeve 104A to the secondary member 154, are not shown in FIG. 4B. As shown in FIG. 4B, the plurality of depressions 114 serve to form a gap or offset between the primary sleeve 102 and the primary member 152 by spacing the primary sleeve 102 away from the primary member 152. This gap or offset receives the plurality of tabs 132, as shown in FIG. 4B. Similarly, as shown in FIG. 4B, the plurality of depressions 146 also serve to form a gap or offset between the secondary sleeve 102A and the secondary member 154 by spacing the secondary sleeve 102A away from the secondary member 154.

In various embodiments, as shown in FIG. 4A-4B, the primary sleeve 102 (and frame member configured to engage therewith) is substantially vertical, while the secondary sleeves 104A, 104B, 104C are non-parallel thereto and hence are at least partially non-vertical. For example, the primary sleeve 102 may be a vertical sleeve and the secondary sleeves 104A, 104B, 104C are horizontal sleeves. As shown in FIG. 4A, the secondary sleeves 104A, 104B, 104C are substantially orthogonal to the primary sleeve 102.

When attached to the primary sleeve 102 and mounted in the structure 150, the secondary sleeves 104A, 104B, 104C provide resistance to torque and forces arising due to the weights of the frame members to mitigate failure of the modular connector 100, as indicated by the illustrative line arrows in FIG. 4B.

The primary sleeve may include a stiffener 158 or reinforcement bracket. The stiffener 158 may be disposed above the frame member 152 and may be integrally coupled to and/or in unitary construction with the primary sleeve 102. For example, the stiffener 158 may be fastened using a fastener and/or welded to the primary sleeve 102. The stiffener 158 may serve to stiffen and strengthen the primary sleeve 102, and the modular connector 100. In some embodiments, the stiffener 158 may function as a stop to ensure that the member 152 is engaged with the primary sleeve 102 via the open-end thereof while hindering passage of the member 152 beyond the stiffener 158 as the member 152 is inserted into the primary sleeve 102.

FIG. 4C is a magnified view of the region 4C in FIG. 4B. The plurality of tabs 132 are angled about 45° relative to the end plate 130.

As shown by the illustrative line arrows in FIG. 4C, as weight is applied to the secondary sleeve 104A, an end of thereof that is distal from the primary sleeve 102 bends downwards so as to push the plurality of tabs 132 into the primary member 152, which generates a force and/or moment reaction to the weight, and to push an outer portion of the supporting end plate 144 into the primary sleeve 102 by pulling an inner portion of the supporting end plate 144 that is fastened to the primary member 152 away from the primary sleeve 102, which also generates a force and/or moment reaction to the weight. Advantageously, by generating opposing moments and forces, the risk of failure of the modular connector 100 may be mitigated.

Figure 5:
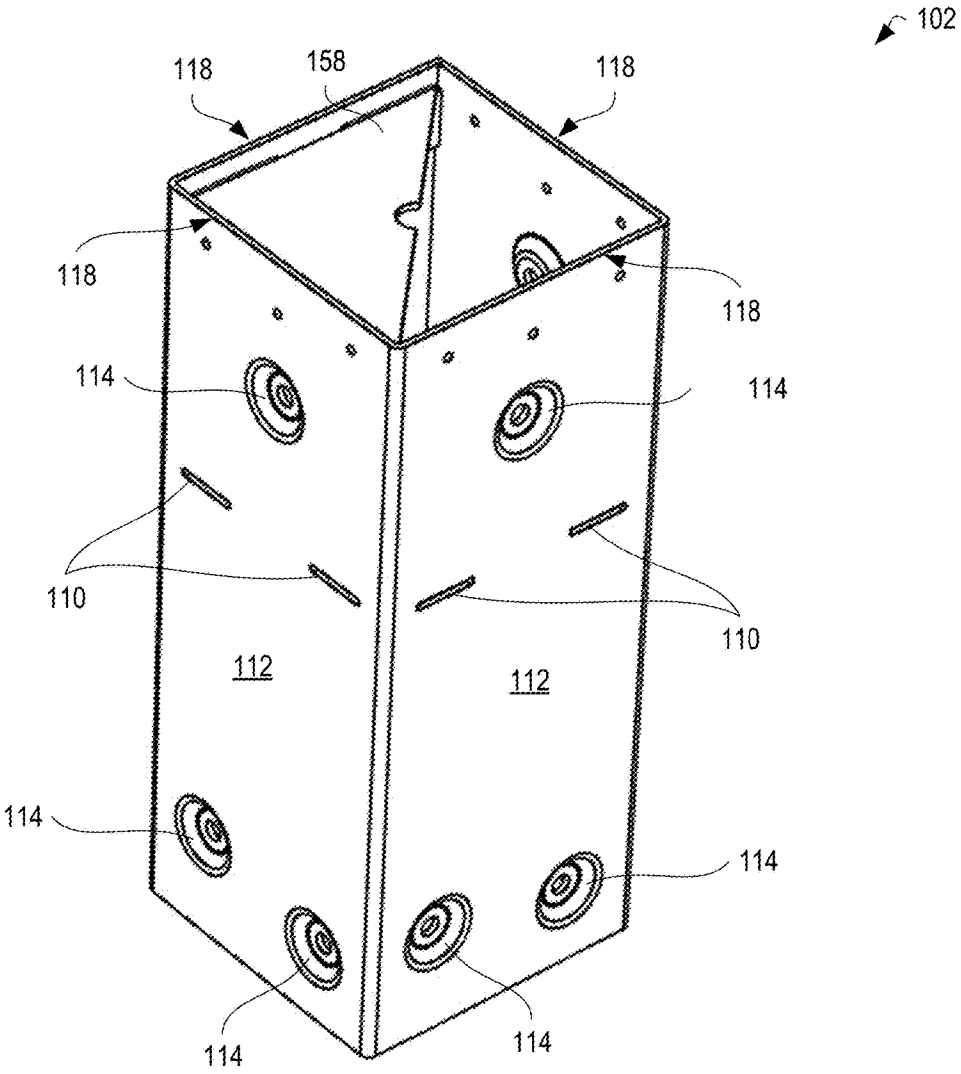
FIG. 5 is a perspective view of a primary sleeve with a cross-section thereof exposed, in accordance with an embodiment.

FIG. 5 is a perspective view of a primary sleeve 102 with a cross-section thereof exposed, in accordance with an embodiment.

As shown in FIG. 5, the stiffener 158 extends at least partially across the socket 108. The stiffener 158 may be spaced apart from the plurality of slots 110 to prevent interference with the frame member 152.

The primary sleeve 102 may be define a rectangular cross-section across which the stiffener 158 is disposed. In some embodiments, the cross-section may be a non-rectangular quadrilateral cross-section. In various embodiments, with a quadrilateral cross-section, the stiffener 158 may be triangularly shaped and extend across two sides 118 of the primary sleeve 102 (and cross-section thereof). In various embodiments, the cross-section may be a non-quadrilateral polygon, and/or curved shape, e.g. the cross-section may be an elliptical or circular cross-section.

In various embodiments, the primary sleeve 102 may be open-ended or comprise a removable cap that is disposed over the stiffener 158 and coupled to the primary sleeve 102 to allow selective opening of the primary sleeve 102. Advantageously such selective opening may facilitate operations within the body of the primary sleeve, e.g. installation of stiffeners, fasteners, or other construction elements. Having a separate cap may facilitate manufacturing using sheet metal.

The stiffener 158 may be provided with an opening or a notch to allow passage of fasteners through the stiffener 158 to allow engagement between the member 152 and the cap.

FIG. 6A is a perspective view of a holder 160 mounted on a modular connector, in accordance with an embodiment.

The holder 160 may be a bracket and may be used to hold textiles, fabrics, wires, straps, and/or other accessories that may be used in combination with an outdoor structure formed using the modular connector 100. For example, a fabric (such as canvas) covering extending over the frame may be attached to the holder 160.

In various embodiments, apertures may be provided in the holder 160 to allow hooking directly on to the holder 160.

It is important to provide a separate holder because the modular connector 100 itself is configured to wrap around the frame members and achieve a compact and strong connection. Extraneous components protruding from the modular connector 100 may not be desirable unless selectively mountable and removable, as well as being aesthetically acceptable.

FIG. 6B is an exploded perspective view of the holder 160.

Figure 6C:
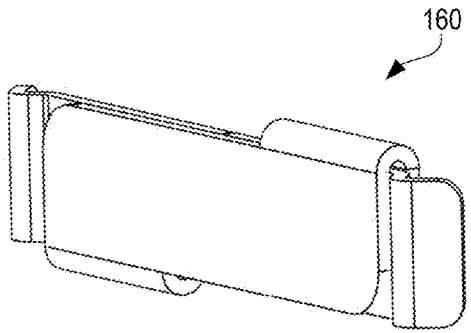
FIG. 6C is a rear perspective view of the holder.

FIG. 6C is a rear perspective view of the holder 160.

FIG. 6D is a front perspective view of the holder 160.

The holder 160 comprises a pair of interlocking pieces 162A, 162B and a coupler 164.

The interlocking pieces 162A, 162B each have a corresponding end 166 that is suitable for being received into a slot 148. For example, the ends 166 may be tabs, hooks, or angular extensions suitable for being hooked into the slots 148 to mitigate movement of the ends 166 out of the corresponding slots 148. Opposing ends of the interlocking pieces 162A, 162B are shaped in a manner that is mutually complementary to allow interlocking. As shown in FIG. 6A-6D, the interlocking pieces 162A, 162B may be shaped to form complementary keyways that engage and disengage with each other in a horizontal direction. As such, the interlocking pieces 162A, 162B provide abutting stops to each other in the vertical direction.

The coupler 164 comprises a pair of pockets 168 defined by walls connected to each other via an intermediate connector 170. In various embodiments, walls and the intermediate connector 170 may be in unitary construction with each other. The pair of pockets 168 may be disposed at opposite ends of the coupler 164 such that the each of the pair of pockets 168 is proximal to a respective piece of the interlocking pieces 162A, 162B and distal from another one of the interlocking pieces 162A, 162B. Each pocket of the pair of pockets 168 may be open in a horizontal direction.

The pair of pockets 168 may have open ends disposed at opposite sides of the coupler 164, and closed ends disposed at opposite sides of the coupler 164. The opposite sides may be defined by vertical ends of the coupler 164 such that each pocket of the pair of pockets 168 defines a vertical stop in at least one vertical direction, at most one vertical direction, or in exactly one vertical direction for parts disposed therein.

Each of interlocking pieces 162A, 162B is received in a corresponding pocket of the pair of pockets 168, e.g. by horizontal or vertical sliding therein, to cause the coupler 164 to bi-directionally half-encase (or envelope) an interlocked piece defined by the interlocking of the interlocking pieces 162A, 162B. The mutually complementary keyways in the interlocking pieces 162A, 162B and the enveloping coupler 164 together prevent vertical movement.

Advantageously, a substantially rigid and robust holder may be achieved without using fasteners and at low cost, since such holder may be achieved with only three parts, each of which may be unitary or of unitary construction.

Advantageously, the holder 160 may be rapidly assembled and disassembled by a user for use. For example, the holder 160 may be assembled without the need for tools.

Figure 7A:
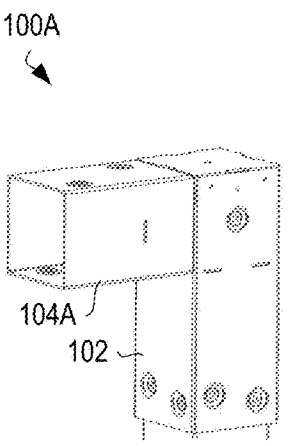
FIG. 7A is a perspective view of a modular connector, in accordance with another embodiment.

FIG. 7A is a perspective view of a modular connector 100A, in accordance with another embodiment.

The modular connector 100A has only a single secondary sleeve 104A that is orthogonal to the primary sleeve 102.

Figure 7B:
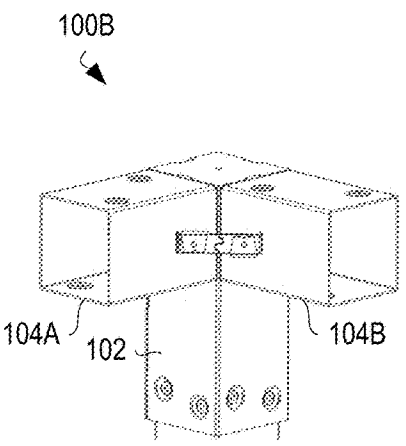
FIG. 7B is a perspective view of a modular connector, in accordance with a further embodiment.

FIG. 7B is a perspective view of a modular connector 1006, in accordance with a further embodiment.

The modular connector 1006 has only two secondary sleeves 104A, 140B that are mutually orthogonal and orthogonal to the primary sleeve 102.

Figure 7C:
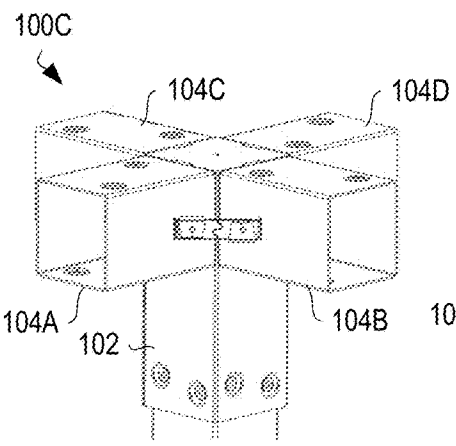
FIG. 7C is a perspective view of a modular connector, in accordance with yet a further embodiment.

FIG. 7C is a perspective view of a modular connector 100C, in accordance with yet a further embodiment.

The modular connector 100C has only four secondary sleeves 104A, 140B, 104C, 104D that form two pairs of mutually orthogonal sleeves, and which are all orthogonal to the primary sleeve 102.

Figure 7D:
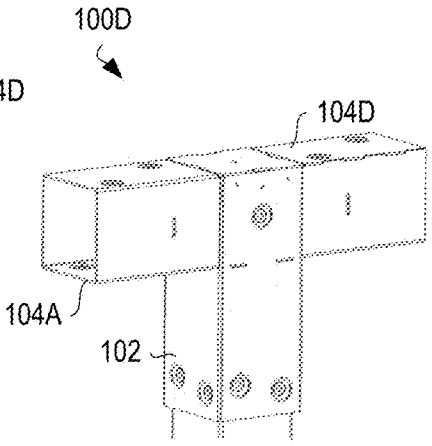
FIG. 7D is a perspective view of a modular connector, in accordance with yet another further embodiment.

FIG. 7D is a perspective view of a modular connector 100D, in accordance with yet another further embodiment.

The modular connector 100D has only two secondary sleeves 104A, 104D that are parallel to each other. The two secondary sleeves 104A, 104D are orthogonal to the primary sleeve 102 and disposed on opposite sides thereof.

The modular connectors 100A, 100B, 100C, 100D, may be reconfigured according to any one of the embodiments shown in FIGS. 7A-7D. For example, a secondary sleeve may be mounted on to the primary sleeve in FIG. 7A to obtain the modular connectors 100C, 100D of FIG. 7C or FIG. 7D.

Figure 8:
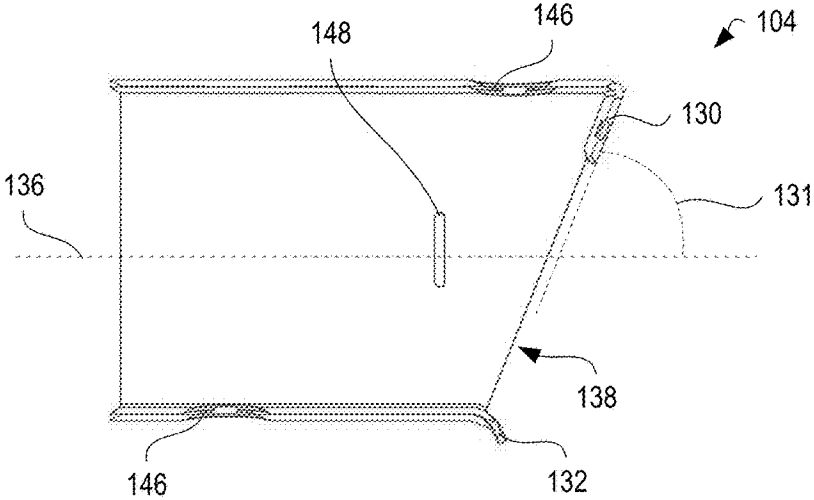
FIG. 8 is a cross-sectional view, in perspective, of a secondary sleeve, in accordance with an embodiment.

FIG. 8 is a cross-sectional view, in perspective, of a secondary sleeve 104, in accordance with an embodiment. The secondary sleeve 104 in FIG. 8, may be suitable for coupling a secondary member non-perpendicularly to a primary member, e.g. for sloped roof joists. As shown in FIG. 8, the end plate 130 may be angled to form an angle 131 that is less than 90° (acute angle) and the plurality of tabs 132 may be axially spaced apart from the end plate 130.

Figure 9:
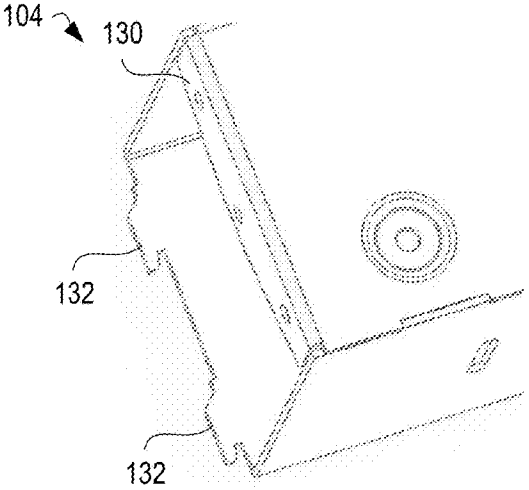
FIG. 9 is a partial perspective view of a secondary sleeve, in accordance with an embodiment.

FIG. 9 is a partial perspective view of a secondary sleeve 104, in accordance with an embodiment. The secondary sleeve 104 defines a plurality of tabs 132 that interlock with the plurality of slots 110, e.g. by hooking thereinto. The plurality of tabs 132 in FIG. 9 may each define a corresponding gap to catch onto the primary sleeve 102.

Figure 10B:
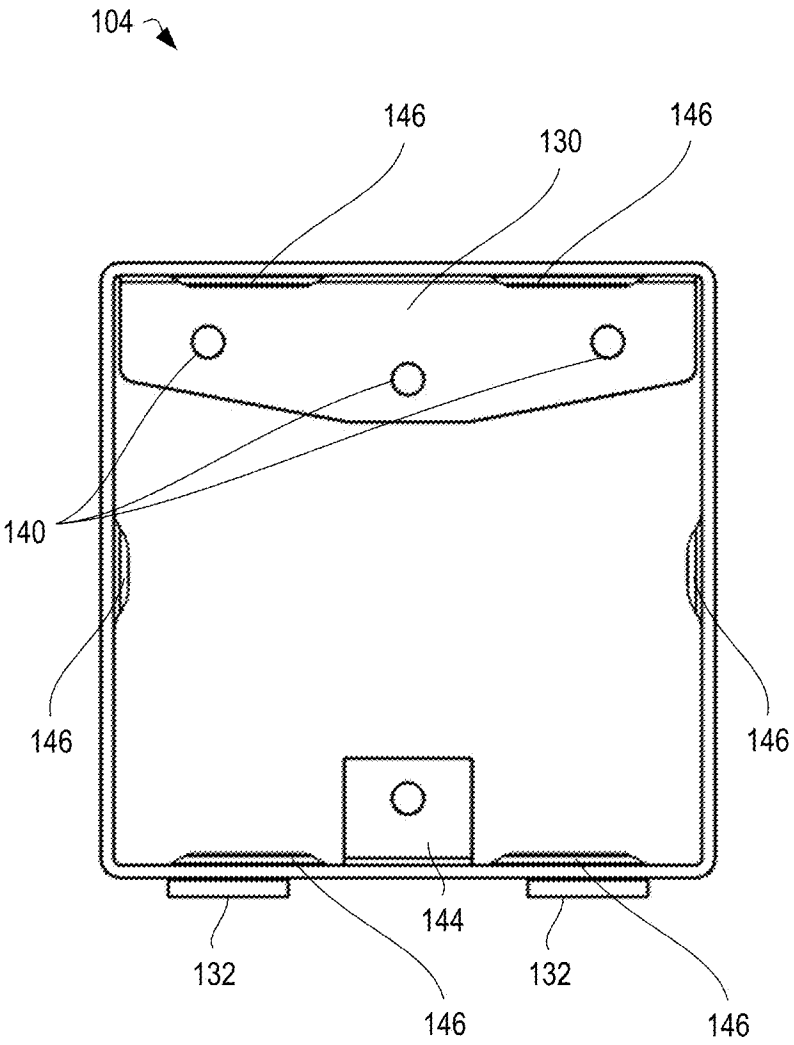
FIG. 10B is a rear elevation of the secondary sleeve of FIG. 10A.
Figure 10A:
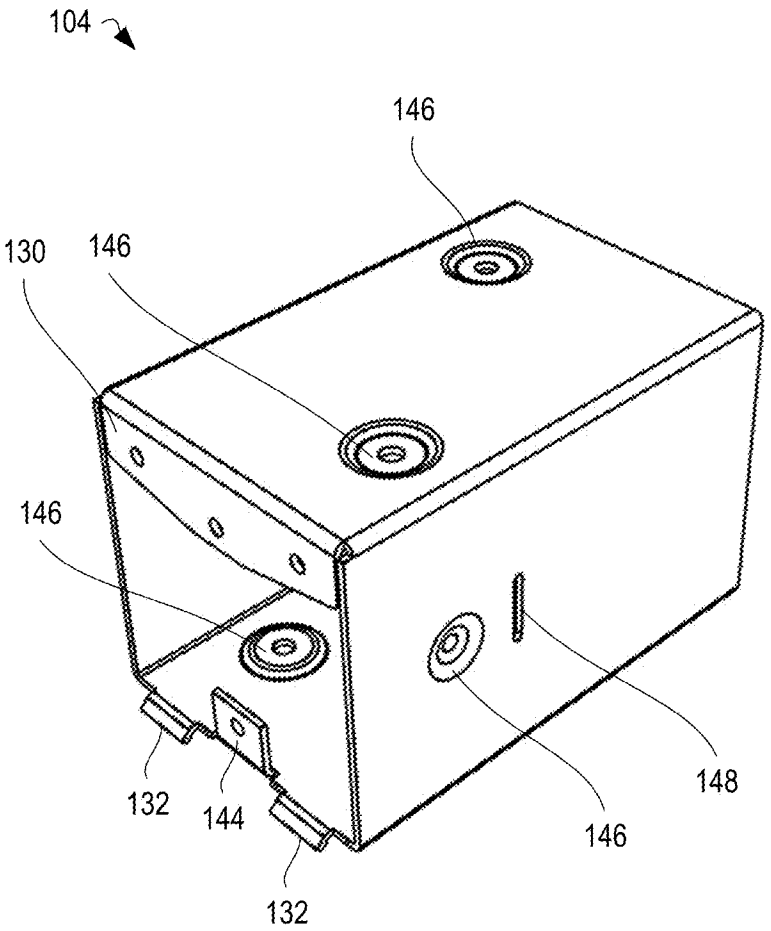
FIG. 10A is a perspective view of a secondary sleeve, in accordance with an embodiment.

FIG. 10A is a perspective view of a secondary sleeve 104, in accordance with an embodiment.

FIG. 10B is a rear elevation of the secondary sleeve 104 of FIG. 10A.

The secondary sleeve 104 in FIGS. 10A-10B includes depression on each side thereof. In particular, depressions 146 are provided in between the slots 146 and the end of the secondary sleeve 104 to center the member 154 inside the secondary sleeve 104.

Figure 11B:
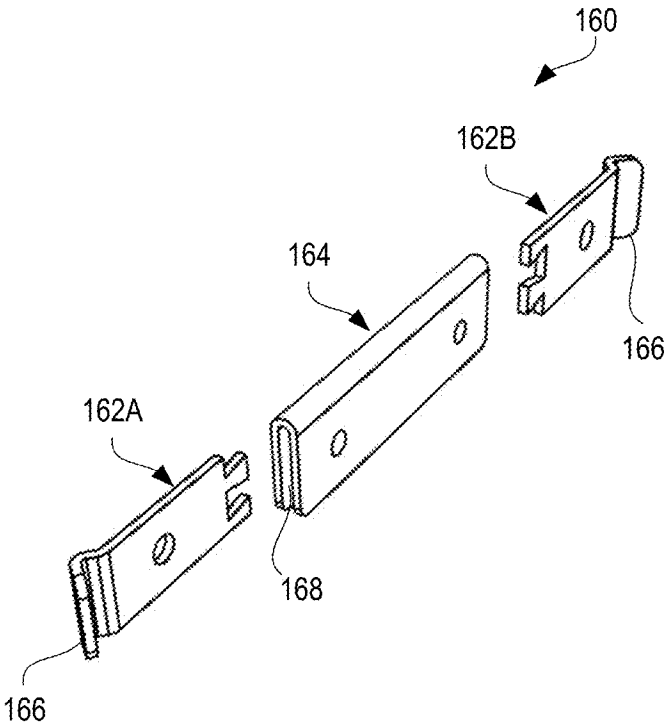
FIG. 11B is an exploded perspective view of the holder of FIG. 11A.
Figure 11A:
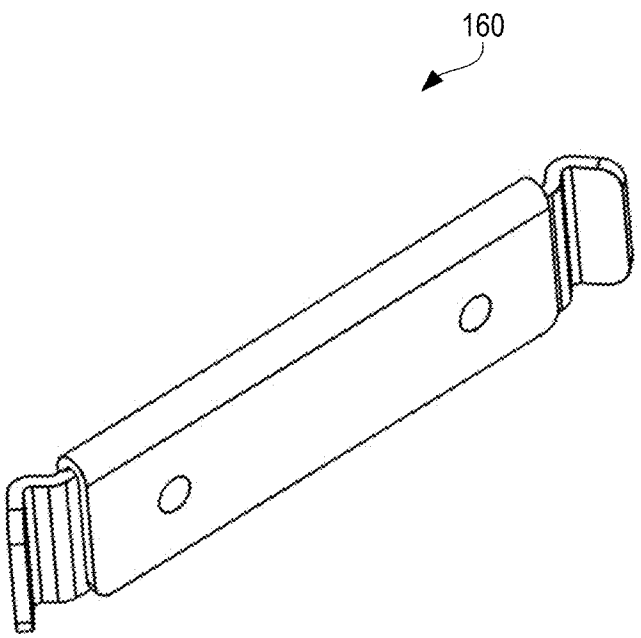
FIG. 11A is a perspective view of a holder, in accordance with an embodiment.

FIG. 11A is a perspective view of another embodiment of a holder 160, in accordance with an embodiment.

FIG. 11B is an exploded perspective view of the holder 160 of FIG. 11A.

The holder in FIG. 11A-11B defines a single elongated pocket 168 defined by a wall having a U-shaped cross-section. The single elongated pocket 168 may be suitable to receive therein both interlocking pieces 162A, 162B. The interlocking pieces 162A, 162B define opposing ends that are mutually complementary dovetails so as to allow interlocking of these ends. The embodiment of the holder 160 in FIGS. 11A-11B may allow faster mounting and may achieve an improved appearance.

An example process of forming a structure may include the following steps: receiving the primary member 152 into the primary sleeve 102 via an open end thereof until contact is made with the stiffener 158, then driving fasteners (such as wood screws or the like) through all the apertures formed in the plurality of depressions 114 to lock the primary member 152 into place, then inserting the plurality of tabs 132 of a secondary sleeve 104 into the plurality of slots 110 to position the secondary sleeve 104, then driving fasteners (such as wood screws or the like) through the plurality of apertures 140 and the plurality of apertures 116 to attach the primary and secondary sleeves 102, 104 to each other, then receiving the secondary member 154 into the secondary sleeve 104, then driving fasteners (such as wood screws or the like) through all the apertures formed in the plurality of depressions 146 to lock the secondary member 154 into place.

In various embodiments, the holder 160 may include a plurality of embossments, e.g. two embossments, defined on one side of the holder and corresponding complementary protrusions facing the inside of the holder to facilitate engagement of the protrusions with apertures, e.g. circular apertures, in the interlocking pieces 162A, 162B.

It is understood that the primary and secondary sleeves are suitable for forming modular connectors to allow a variety of connectors to be formed via a much smaller set of unique connectors. In some cases, such connectors may then be welded, e.g. the edges of the primary and secondary sleeves may be suitable to allow wire welding to improve mating between sleeves. Further, in some cases, a manufacturing process may utilize the modular connectors, formed using the primary and secondary sleeves, to form integrated connectors. For example, once a modular connector is formed, the modular connector assembly may be transformed into a unitary component representing a desired connector by diffusion welding, or other methods of joining materials.

As can be understood, the examples described above and illustrated are intended to be exemplary only. The embodiments described in this document provide non-limiting examples of possible implementations of the present technology. Upon review of the present disclosure, a person of ordinary skill in the art will recognize that changes may be made to the embodiments described herein without departing from the scope of the present technology. For example, the modular connector may be used to form angled corners for a roof truss, the sleeves of the modular connector may have non-square or non-rectangular cross-sections, self-tapping screws may be used to fasten sleeves to each other, and one or more welds may be provided at joints between the various sleeves to further improve the strength of connectors once assembled. Yet further modifications could be implemented by a person of ordinary skill in the art in view of the present disclosure, which modifications would be within the scope of the present technology.

What is claimed is:

1. A modular connector for coupling a first frame member to a second frame member at a predetermined angle, comprising:

a first sleeve defining a first longitudinal axis and a first socket suitable to receive therein the first frame member, the first sleeve having an axially extending outer face, the outer face defining a plurality of slots thereon; and a second sleeve defining a second longitudinal axis, a terminal end along the second longitudinal axis, and a second socket suitable to receive therein the second frame member, the second sleeve including:

a plurality of tabs extending away from the second socket from the terminal end, the plurality of tabs being receivable in the plurality of slots to position the second sleeve relative to the first sleeve, and an end plate extending from the terminal end towards the second socket to abut and fasten to the outer face of the first sleeve when each of the plurality of tabs is engaged with the plurality of slots to allow removable coupling of the first sleeve to the second sleeve, the end plate being angled relative to the second longitudinal axis to position the first frame member at the predetermined angle relative to the second frame member when the end plate is fastened in abutment to the outer face;

wherein a first plurality of apertures is defined on the outer face and is complementary to a second plurality of apertures of the end plate, the first and second plurality of apertures being suitable to receive fasteners to allow engagement of the first sleeve with the second sleeve via the fasteners, and wherein each of the first plurality of apertures is axially spaced apart from the plurality of slots and opens to the first socket to allow the fasteners to extend into the first socket via the first plurality of apertures to fasten the second sleeve to the first frame member.

2. The modular connector of claim 1, wherein each of the plurality of tabs is substantially non-parallel to the end plate.

3. The modular connector of claim 1, wherein the plurality of tabs and the end plate are positioned at opposite lateral sides of the second sleeve.

4. The modular connector of claim 1, wherein the plurality of tabs includes two spaced-apart tabs positioned at a common side of the second sleeve opposite to the end plate.

5. The modular connector of claim 1, wherein each tab of the plurality of tabs is interlockable with a corresponding slot of the plurality of slots.

6. The modular connector of claim 1, wherein the first sleeve includes a plurality of depressions extending from the outer face into the first socket to form a gap between the first frame member and the first sleeve to receive the plurality of tabs when the first frame member is received in the first sleeve.

7. The modular connector of claim 1, wherein the end plate is a first end plate, the second sleeve including a second end plate extending from the terminal end towards the second socket and opposite to the first end plate to abut and fasten to the outer face of the first sleeve when each of the plurality of tabs is received in the plurality of slots.

8. A modular connector for coupling a first frame member to a second frame member at a predetermined angle, comprising:

a first sleeve defining a first longitudinal axis and a first socket suitable to receive therein the first frame member, the first sleeve having an axially extending outer face, the outer face defining a plurality of slots thereon; and a second sleeve defining a second longitudinal axis, a terminal end along the second longitudinal axis, and a second socket suitable to receive therein the second frame member, the second sleeve including:

a plurality of tabs extending away from the second socket from the terminal end, the plurality of tabs being receivable in the plurality of slots to position the second sleeve relative to the first sleeve, and an end plate extending from the terminal end towards the second socket to abut and fasten to the outer face of the first sleeve when each of the plurality of tabs is engaged with the plurality of slots to allow removable coupling of the first sleeve to the second sleeve, the end plate being angled relative to the second longitudinal axis to position the first frame member at the predetermined angle relative to the second frame member when the end plate is fastened in abutment to the outer face;

wherein the first sleeve includes a plurality of depressions extending from the outer face into the first socket to space the first frame member away from the first sleeve to form a gap receiving the plurality of tabs when the first frame member is received in the first sleeve.

9. The modular connector of claim 8, wherein each of the plurality of depressions is suitable to receive a corresponding fastener to allow fastening of the first sleeve to the first frame member.

10. The modular connector of claim 8, wherein a first plurality of apertures is defined on the outer face and is complementary to a second plurality of apertures of the end plate, the first and second plurality of apertures being suitable to receive fasteners to allow engagement of the first sleeve with the second sleeve via the fasteners, the first plurality of apertures being axially spaced apart from the plurality of slots, a depression of the plurality of depressions being positioned axially in-between the first plurality of apertures and the plurality of slots.

11. A modular connector for coupling a first frame member to a second frame member at a predetermined angle, comprising:

a first sleeve defining a first longitudinal axis and a first socket suitable to receive therein the first frame member, the first sleeve having an axially extending outer face, the outer face defining a plurality of slots thereon; and a second sleeve defining a second longitudinal axis, a terminal end along the second longitudinal axis, and a second socket suitable to receive therein the second frame member, the second sleeve including:

a plurality of tabs extending away from the second socket from the terminal end, the plurality of tabs being receivable in the plurality of slots to position the second sleeve relative to the first sleeve, and an end plate extending from the terminal end towards the second socket to abut and fasten to the outer face of the first sleeve when each of the plurality of tabs is engaged with the plurality of slots to allow removable coupling of the first sleeve to the second sleeve, the end plate being angled relative to the second longitudinal axis to position the first frame member at the predetermined angle relative to the second frame member when the end plate is fastened in abutment to the outer face;

wherein the first sleeve includes a stiffener extending at least partially across the first socket, and being spaced apart from the plurality of slots to prevent interference with the first frame member, and wherein the first sleeve defines a quadrilateral cross-section, the stiffener being triangularly shaped and extending across two sides of the quadrilateral cross-section.

12. A modular connector for coupling a first frame member to a second frame member at a predetermined angle, comprising:

a first sleeve defining a first longitudinal axis and a first socket suitable to receive therein the first frame member, the first sleeve having an axially extending outer face, the outer face defining a plurality of slots thereon; and a second sleeve defining a second longitudinal axis, a terminal end along the second longitudinal axis, and a second socket suitable to receive therein the second frame member, the second sleeve including:

a plurality of tabs extending away from the second socket from the terminal end, the plurality of tabs being receivable in the plurality of slots to position the second sleeve relative to the first sleeve, and an end plate extending from the terminal end towards the second socket to abut and fasten to the outer face of the first sleeve when each of the plurality of tabs is engaged with the plurality of slots to allow removable coupling of the first sleeve to the second sleeve, the end plate being angled relative to the second longitudinal axis to position the first frame member at the predetermined angle relative to the second frame member when the end plate is fastened in abutment to the outer face;

wherein the end plate is a first end plate, the second sleeve including a second end plate extending from the terminal end towards the second socket and opposite to the first end plate to abut and fasten to the outer face of the first sleeve when each of the plurality of tabs is received in the plurality of slots.

13. The modular connector of claim 12, wherein the plurality of tabs includes two spaced-apart tabs positioned at a common side of the second sleeve opposite to the first end plate, the second end plate being positioned between the two spaced-apart tabs.

14. A structure, comprising:

a first frame member;

a second frame member;

a modular connector coupling the first frame member to the second frame member at a predetermined angle, the modular connector comprising:

a first sleeve defining a first longitudinal axis and a first socket suitable to receive therein the first frame member, the first sleeve having an axially extending outer face, the outer face defining a plurality of slots thereon; and a second sleeve defining a second longitudinal axis, a terminal end along the second longitudinal axis, and a second socket suitable to receive therein the second frame member, the second sleeve including:

a plurality of tabs extending away from the second socket from the terminal end, the plurality of tabs being receivable in the plurality of slots to position the second sleeve relative to the first sleeve, and an end plate extending from the terminal end towards the second socket to abut and fasten to the outer face of the first sleeve when each of the plurality of tabs is engaged with the plurality of slots to allow removable coupling of the first sleeve to the second sleeve, the end plate being angled relative to the second longitudinal axis to position the first frame member at the predetermined angle relative to the second frame member when the end plate is fastened in abutment to the outer face, the first frame member being received in the first sleeve, the second frame member being received in the second sleeve; and a plurality of fasteners at least partially passing through the end plate, the outer face of the first sleeve, and the first frame member to cause frictional engagement therebetween to fasten the first sleeve, the second sleeve, and the first frame member to each other.

15. The structure of claim 14, wherein each of the plurality of fasteners is received in a corresponding one of a plurality of apertures defined in each of the end plate and the outer face.

16. The structure of claim 14, wherein the first sleeve includes a first plurality of depressions extending from the outer face into the first socket to frictionally engage with the first frame member, the second sleeve including a second plurality of depressions extending into the second socket to frictionally engage with the second frame member, each depression of the first and second plurality of depressions receiving a corresponding fastener of the plurality of fasteners.

17. The structure of claim 16, wherein each of the plurality of fasteners is received in a corresponding one of a plurality of apertures defined in each of the end plate and the outer face, and a depression of the first plurality of depressions being spaced-apart from and positioned axially in-between the plurality of apertures and the plurality of slots.

18. The structure of claim 14, wherein the end plate is a first end plate, the second sleeve including a second end plate extending from the terminal end towards the second socket and opposite to the first end plate to abut and fasten to the outer face of the first sleeve when each of the plurality of tabs is received in the plurality of slots.

19. The structure of claim 18, wherein each of the plurality of fasteners is received in a corresponding one of a plurality of apertures defined in each of the end plate and the outer face; wherein the first sleeve includes a first plurality of depressions extending from the outer face into the first socket to frictionally engage with the first frame member, the second sleeve including a second plurality of depressions extending into the second socket to frictionally engage with the second frame member, each depression of the first and second plurality of depressions receiving a corresponding fastener of the plurality of fasteners; wherein each of the plurality of fasteners is received in a corresponding one of a plurality of apertures defined in each of the end plate and the outer face, and a depression of the first plurality of depressions being spaced-apart from and positioned axially in-between the plurality of apertures and the plurality of slots.

20. The sleeve of claim 19, further comprising A sleeve of a modular connector for coupling a first frame member to a second frame member at a predetermined angle, the modular connector including a common sleeve defining a first longitudinal axis and a first socket suitable to receive therein the first frame member, the common sleeve having an axis and a plurality of slots defined on an axially extending outer face of the common sleeve, the sleeve being axially elongated and defining:

an axially terminal end;

a second socket suitable to engageably receive therein the second frame member;

a plurality of tabs extending away from the second socket from the axially terminal end and receivable in the plurality of slots to position the sleeve relative to the common sleeve;

an end plate extending from the axially terminal end towards the second socket to abut and fasten to the outer face of the common sleeve when each of the plurality of tabs is received in the plurality of slots to allow removable coupling of the sleeve to the common sleeve, the end plate being angled to allow the first frame member to be positioned at the predetermined angle relative to the second frame member when the end plate is fastened in abutment to the outer face; and a plurality of depressions extending laterally inwardly towards the second socket to cause an interference fit between the sleeve and the second frame member when the second frame member is received in the second socket.

21. The sleeve of claim 20, wherein each of the plurality of depressions defines an aperture for receiving a corresponding fastener to allow fastening of the sleeve to the second frame member, the sleeve further comprising a plurality of apertures suitable to receive a plurality of fasteners to allow engagement of the sleeve with the common sleeve and the first frame member via the fasteners.

* * * * *